US005603632A

United States Patent [19]

Johannes et al.

[11] Patent Number: 5,603,632

[45] Date of Patent: Feb. 18, 1997

[54] ELECTRICAL CONNECTOR AND CONNECTOR ASSEMBLY

[75] Inventors: Richard A. Johannes, Greer, S.C.; Kevin G. Henderson, Gastonia, N.C.

[73] Assignee: Thomas & Betts Corporation, Memphis, Tenn.

[21] Appl. No.: 386,022

[22] Filed: Feb. 9, 1995

[51] Int. Cl.[6] ..... H01R 13/627

[52] U.S. Cl. ..... 439/357

[58] Field of Search ..... 439/352, 489, 439/357, 358, 188

[56] References Cited

U.S. PATENT DOCUMENTS

| | | | |
|---|---|---|---|
| 3,903,385 | 9/1975 | Moyer et al. | 200/51.1 |
| 4,070,557 | 1/1978 | Ostapovitch | 200/51.1 |
| 4,708,413 | 11/1987 | Schroeder | 439/352 |
| 4,894,019 | 1/1990 | Howard | 439/188 |
| 4,946,404 | 8/1990 | Takenouchi et al. | 439/352 |
| 4,950,179 | 8/1990 | Takenouchi et al. | 439/357 |
| 4,978,311 | 12/1990 | Oda et al. | 439/188 |
| 5,011,423 | 4/1991 | Reuter | 439/341 |
| 5,041,017 | 8/1991 | Nakazato et al. | 439/509 |
| 5,055,058 | 10/1991 | Nagasaka et al. | 439/188 |
| 5,071,362 | 12/1991 | Martens et al. | 439/188 |
| 5,085,592 | 2/1992 | Sekiguchi | 439/188 |
| 5,112,238 | 5/1992 | Cizin | 439/188 |
| 5,116,236 | 5/1992 | Colleran et al. | 439/271 |
| 5,145,391 | 9/1992 | Alwine | 439/188 |
| 5,203,719 | 4/1993 | Kozono | 439/489 |
| 5,226,834 | 7/1993 | Kato et al. | 439/489 |
| 5,257,944 | 11/1993 | Kennedy | 439/347 |
| 5,277,608 | 1/1994 | Oda | 439/188 |

*Primary Examiner*—P. Austin Bradley
*Assistant Examiner*—Yong Kim
*Attorney, Agent, or Firm*—Michael L. Hoelter; Salvatore J. Abbruzzese

[57] ABSTRACT

An electrical connector assembly comprises a first housing supporting an array of first contacts and defining a passage for receipt of a CPA (connection positive assurance) component, a second housing matable with the first housing by movement along a connection axis and having an array of second contacts for mating engagement with the array of first contacts, a CPA member having a first portion movable in the first housing passage and a having a second portion, and first and second latch members respectively with the first and second housings and engageable in the course of mating thereof, the first latch means being disposed in a path of movement of the CPA member second portion. The first and second latch members effect a first measure of securement of the first and second housings, and the CPA is engageable with the first latch member for effecting a second, cumulative measure of securement of the first and second housings.

25 Claims, 6 Drawing Sheets

ELECTRICAL CONNECTOR AND CONNECTOR ASSEMBLY

FIELD OF THE INVENTION

This invention relates generally to electrical connectors and assemblies thereof and pertains more particularly to electrical connectors having a "connection position assurance" feature.

BACKGROUND OF THE INVENTION

In various applications, the connector industry confronts enhanced requirements for exact and assured electrical mating of connector contacts. One such application is in the electrical circuitry associated with automobile air bags, where misconnection can give rise to manifest difficulty. In seeking to meet the requirements, the industry has adopted an approach called "connection position assurance" (CPA), wherein a CPA component additional to the electrical connection structure is provided and is configured jointly with connector structure so as to provide indication assuring that there is exact electrical mating of connector contacts.

Typically, the CPA component is so configured that it is not insertable into the connector assembly unless the connector header and socket thereof are so engaged as to provide exact electrical mating of connector contacts.

Examples of known CPA components are seen in U.S. Pat. No. 5,011,423, U.S. Pat. No. 5,041,017, U.S. Pat. No. 5,055,058, U.S. Pat. No. 5,116,236, U.S. Pat. No. 5,203,719, U.S. Pat. No. 5,226,834 and U.S. Pat. No. 5,257,944. Such known CPA components are seen as unduly complex in configuration.

SUMMARY OF THE INVENTION

The present invention has as its primary object the provision of simplified CPA components and connectors and connector assemblies employing the same.

A further object of the invention is to provide CPA-equipped electrical connectors wherein the CPA component has function additional to its indication of the presence of required exact mating of electrical contacts.

In attaining the foregoing and other objects, the invention provides an electrical connector assembly, comprising a first housing supporting an array of first contacts and defining a passage for receipt of a CPA component, a second housing matable with the first housing by movement along a connection axis and having an array of second contacts for mating engagement with the array of first contacts, a CPA member having a first portion movable in the first housing passage and a having a second portion, and first and second latch members respectively with the first and second housings and engageable in the course of mating thereof, the first latch means being disposed in a path of movement of the CPA member second portion.

From another perspective, the invention provides an electrical connector assembly, comprising a first housing supporting an array of first contacts and defining a passage for receipt of a CPA component, a second housing matable with the first housing by movement along a connection axis and having an array of second contacts for mating engagement with the array of first contacts, first and second latch members respectively with the first and second housings and engageable for effecting a first measure of securement of the first and second housings, and a CPA member movable in the first housing passage and engageable with the first latch member for effecting a second measure of securement of the first and second housings.

In the particularly preferred embodiment of a connector assembly in accordance with the invention, the first latch means includes a first end portion extending upwardly of an uppermost surface of the first housing adjacent the first housing passage. The CPA member engages the first latch means first end portion in the course of CPA member movement in the first housing passage for effecting the second measure of securement of the first and second housings.

From the viewpoint of an individual connector, the invention provides an electrical connector comprising a housing, a plurality of electrical contacts supported in the housing along a connection axis, a CPA member supported by the housing, and a latch member having first and second opposed ends, the latch member being supported by the housing for pivotal movement at a location between the first and second opposed ends.

The foregoing and other objects and features of the invention will be further understood from the following detailed discussion of preferred practices and embodiments thereof and from the drawings wherein like reference numerals identify like components and part throughout.

DESCRIPTION OF THE PREFERRED EMBODIMENT AND PRACTICES

Figure 1:
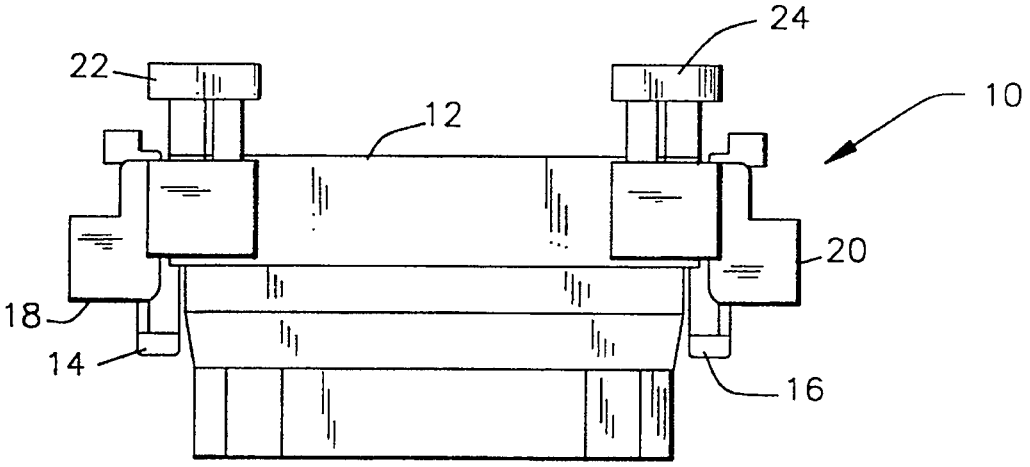
FIG. 1 is a front elevation of a socket of a connector assembly in accordance with the invention.
Figure 2:
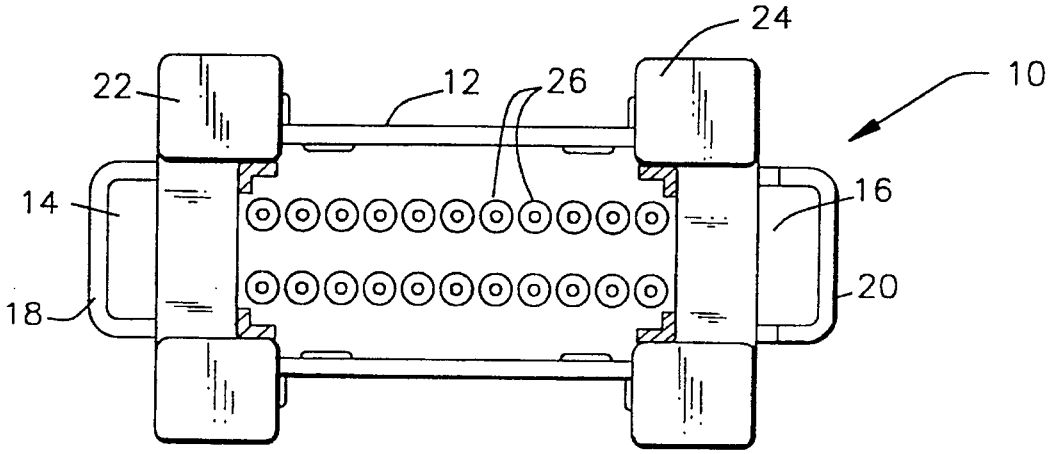
FIG. 2 is a top plan view of the FIG. 1 socket.
Figure 3:
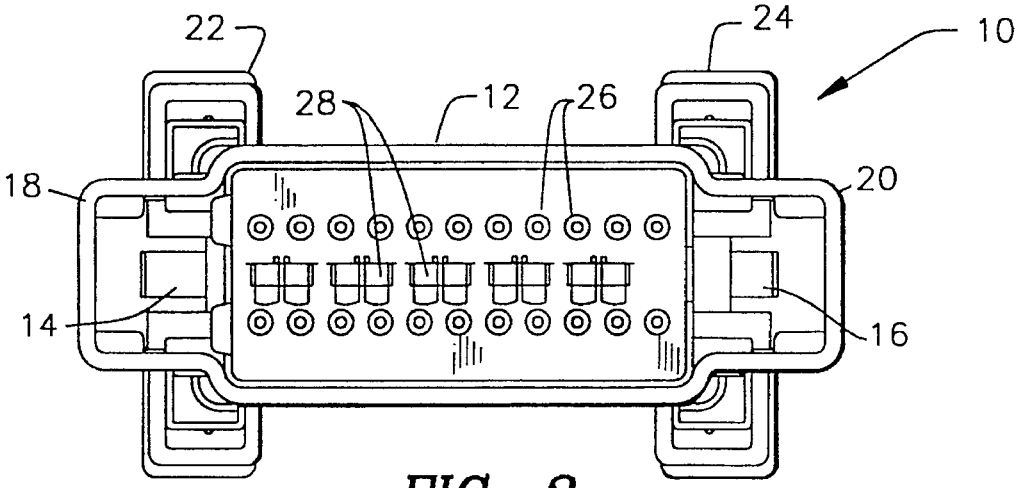
FIG. 3 is a bottom plan view of the FIG. 1 socket.

Referring to FIGS. 1–3, socket 10 is comprised of a body 12 of electrically insulative material. Latch members 14 and 16 are retained with body 12, although separately fabricated also of electrically insulative material. The latch members are disposed in retaining nests 18 and 20 of body 10.

CPA members 22 and 24 are seatable in respective passages (discussed below) formed in body 12 aside retaining nests 18 and 20.

Socket contacts 26 are seated in body 10, as are shorting contacts 28, the latter shunting socket contact pairs when the socket is not mated to a header.

As is seen particularly in FIGS. 14–18, shorting contacts 28 are insertable in passages P which open into the bottom of socket 10 and include a U-shaped bridge portion 28*a* and resilient legs 28*b* and 28*c*, which depend from the bridge portion and have feet 28*b*-1 and 28*c*-1, which engage contacts 26. Contacts 28 are positioned in body 12 by eyelets 28*d* registering with body projections 12*a* and are supported further by portions 28*a* frictionally engaging the walls of passages P.

Figure 5:
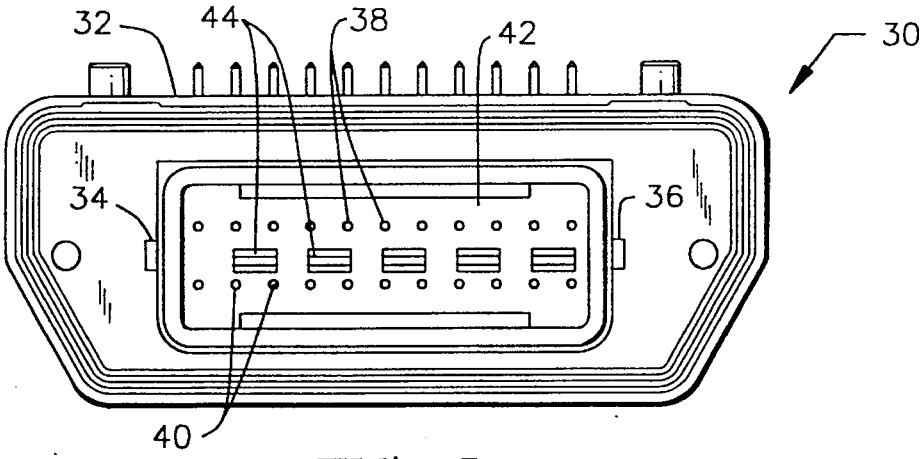
FIG. 5 is a top plan view of the FIG. 4 header.
Figure 4:
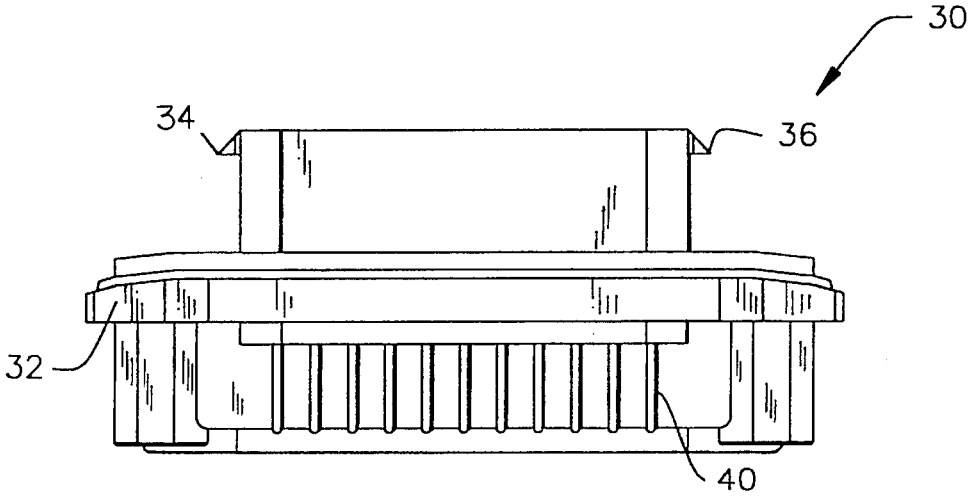
FIG. 4 is a front elevation of a header of a connector in accordance with the invention.
Figure 6:
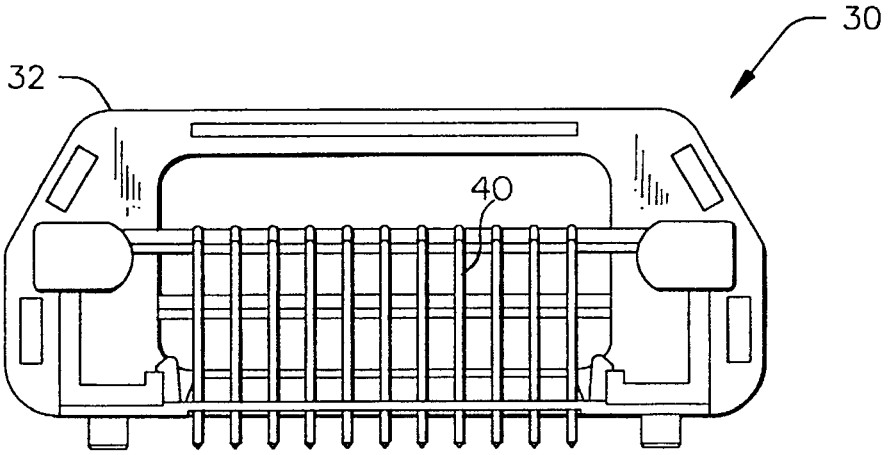
FIG. 6 is a bottom plan view of the FIG. 4 header.
Figure 8:
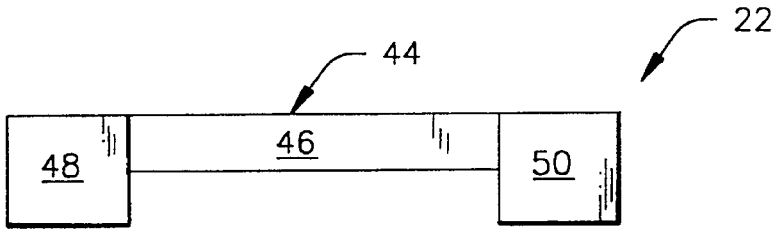
FIG. 8 is a top plan view of the FIG. 7 CPA member.
Figure 7:
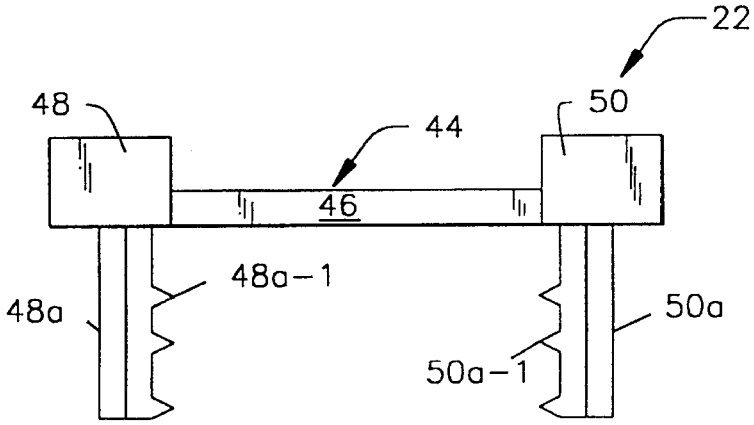
FIG. 7 is an enlarged front elevation of the CPA member of FIG. 1.
Figure 9:
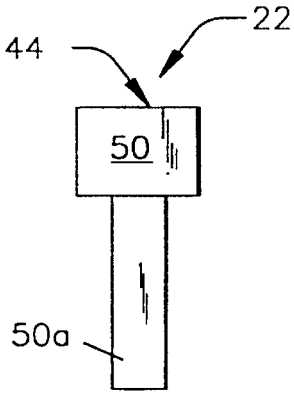
FIG. 9 is a right side view of the FIG. 7 CPA member.
Figure 10:
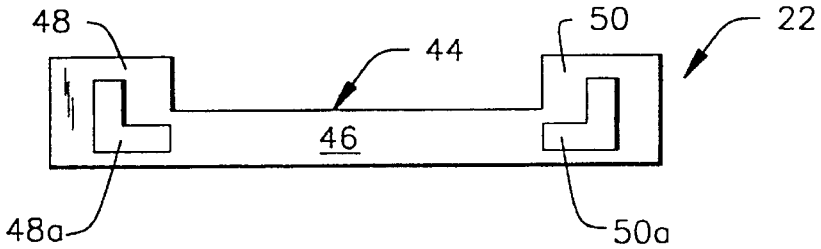
FIG. 10 is a bottom plan view of the FIG. 7 CPA member.

Referring to FIGS. 4–6, header 30 is comprised of a body 32 of electrically insulative material. Latching projections 34 and 36 are formed integrally with body 32 and extend outwardly thereof. Male contact pins 38 and 40 are supported in body 32 in respective laterally spaced rows with first free ends (FIG. 5) extending upwardly for engagement with socket contacts 26 upon mating of header 30 with socket 10. Contact pins 38 and 40 are formed with right-angle bends, such that opposite free ends extend horizontally outwardly of the header (FIG. 6).

Figure 18:
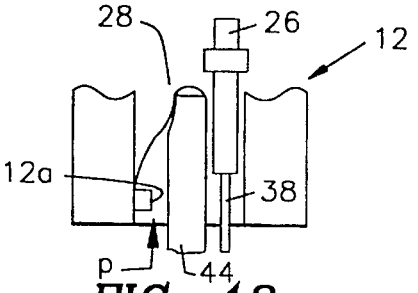
FIG. 18 is a schematic view showing a shorting contact displaced from engagement with a female contact of the FIG. 1 socket.
Figure 14:
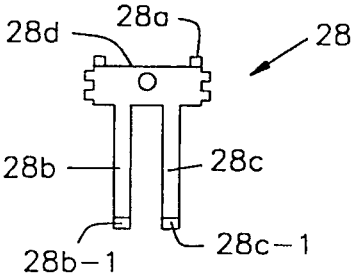
FIG. 14 is an enlarged front elevation of a shorting contact of the FIG. 1 socket.
Figure 16:
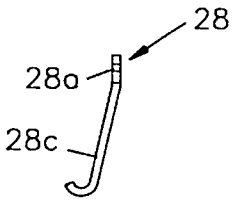
FIG. 16 is a right side view of the FIG. 14 shorting contact.

Upstanding from header base 42 are projections 44, formed integrally with body 32 and so disposed as to enter socket 10 and interrupt the shunting action of shorting contacts 28 (FIG. 18).

Turning to FIGS. 7–10, CPA member 22 is a one-piece rigid plastic member having a bridge 46, side plungers 48 and 50 with legs 48*a* and 50*a* having sawtooth portions 48*a*-1 and 50*a*-21. CPA member 24 is likewise configured.

Figure 12:
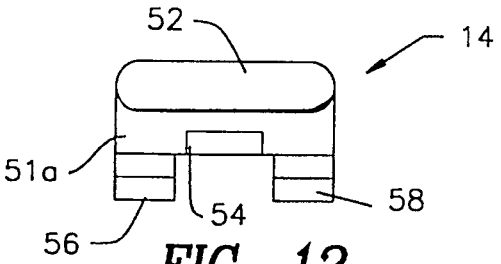
FIG. 12 is a top plan view of the FIG. 11 latch member.
Figure 11:
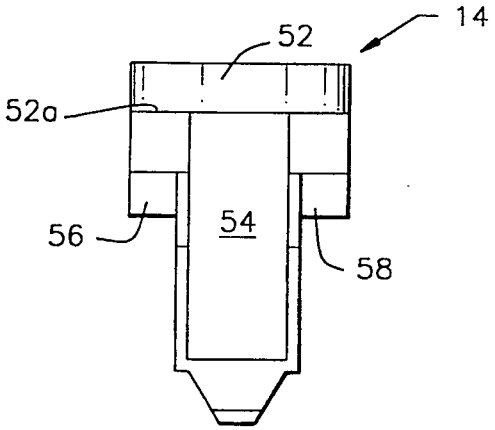
FIG. 11 is an enlarged front elevation of a latch member of the FIG. 1 socket.
Figure 13:
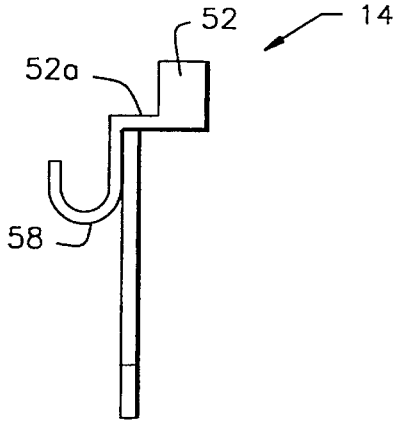
FIG. 13 is a right side view of the FIG. 11 latch member.

FIGS. 11–13 depict latch member 14. At its top portion 52, latch member 14 has a seat 52*a* for receipt of bridge 46 of CPA member 44. Depending below seat 52*a* is an elongate recess 54 for receipt of a header latching projection. Latch member 14 further includes curved side wings 56 and 58 for retaining it in the socket retaining nest. Latch member 16 is likewise configured.

Figure 20:
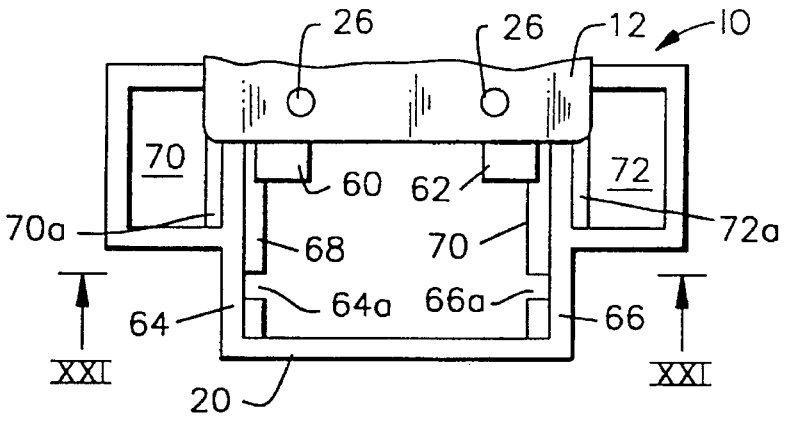
FIG. 20 is a top plan view of FIG. 19, with the latch member not yet inserted and showing interior details.
Figure 19:
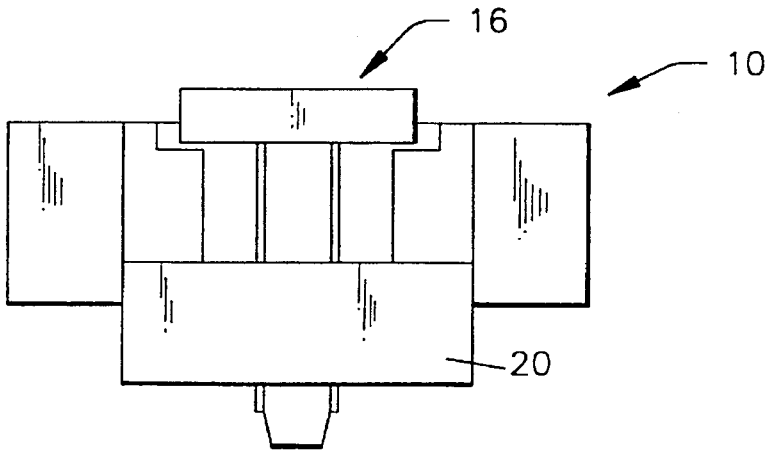
FIG. 19 is a right side elevation of the upper portion of the socket of FIG. 1.
Figure 21:
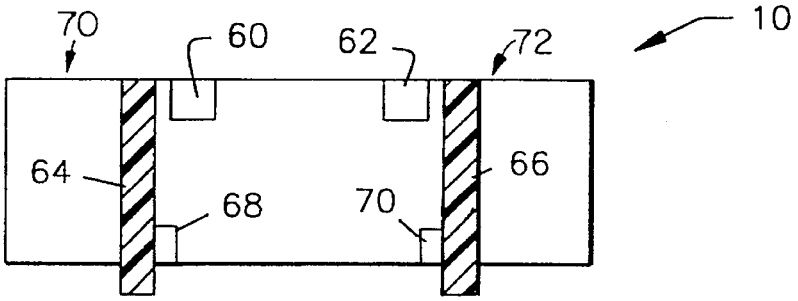
FIG. 21 is a right side elevation of the upper portion of the socket of FIG. 19 as would be seen from plane XXI—XXI of FIG. 20.

In FIG. 19, the upper right side portion of socket 10 is shown with latch member 16 disposed in retaining nest 20. In the top plan elevation of FIG. 19, shown in FIG. 20, latch member 16 has not yet been inserted and details of support structure therefor can be seen. FIG. 21 is a sectional view as would be seen from plane XXI—XXI of FIG. 20, i.e., that portion of retaining nest 20 which projects sidewardly outwardly of socket 10 is removed. As is shown, socket 10 has upper projections 60 and 62 and the sidewalls 64 and 66 of retaining nest have lower projections 68 and 70.

In assembling the latch member with the socket, the former is inserted into the top of retaining nest 20 and forced downwardly into sidewall slots 64*a* and 66*a*. Wings 56 and 58 (FIG. 11) are ensnared respectively between projections 60 and 64 and projections 62 and 64, thereby securing the latch member with the socket within nest 20. By this arrangement,the latch member, which has first and second opposed ends, is supported by the housing for pivotal movement at a location between the first and second opposed ends.

CPA member 24 is assembled with socket 10 by insertion of its legs 48*a* and 50*a* into socket passages 70 and 72, each of which include a sidewall sawtooth projection 70*a* and 72*a*, which mesh respectively with CPA member sawtooth portions 48*a*-1 and 50*a*-1. The outset assembly is partial., i.e., bridge 46 of the CPA member is spaced from the upper surface of socket 10, and particularly from the top portion 52 of latch member 16 in that only its lowermost sawteeth are in mesh with projections 70*a* and 72*a*.

Figure 17:
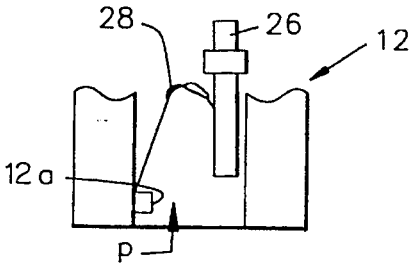
FIG. 17 is a schematic view showing a shorting contact in engagement with a female contact of the FIG. 1 socket.
Figure 15:
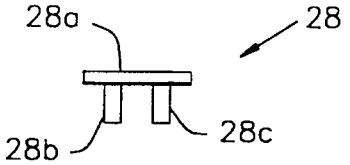
FIG. 15 is a top plan view of the FIG. 14 shorting contact.

With socket 10 so arranged, i.e., with its female contacts and shorting contacts in place, and with latch and CPA members assembled therewith as above discussed, the socket stands with respective pairs of its female contacts shorted by the shorting contacts 28, and ready for assembly with the header (FIG. 17).

In the outset course of assembly of the header with the socket, projections 44 of the header enter the socket passages P and lift shorting contacts 28 from their shunting engagement with the socket female contacts 26. On continued assembly, electrical engagement occurs as between socket female contacts 26 and header male contacts 38 and 40. On further assembly, header latching projections 34 and 36 enter recesses 54 of the socket latch members.

Figure 22:
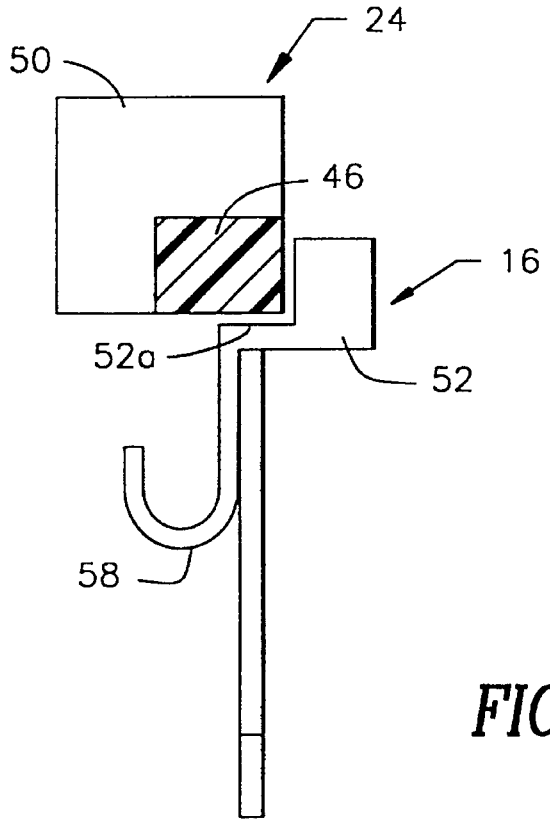
FIG. 22 depicts a situation in which the CPA member is seated properly with respect to the latch member.

If the assembly thus reached is electrically as described, the CPA members will be properly aligned with the socket latch members, and the CPA members can be fully seated in the socket, as depicted in FIG. 22, providing indication of connection position assurance.

A first measure of securement of the header and socket is afforded by the seating of header latching projections in the socket latch member recesses. In the course of seating of the CPA members, a second, cumulative measure of securement of the header and socket is achieved. Thus, given the pivotal support of the latch members, the CPA members impart outward movement to the latch member top portions and the latch members pivot about the retained latch member wings to dispose the header latching projections more snugly in the socket latch member recesses.

Figure 23:
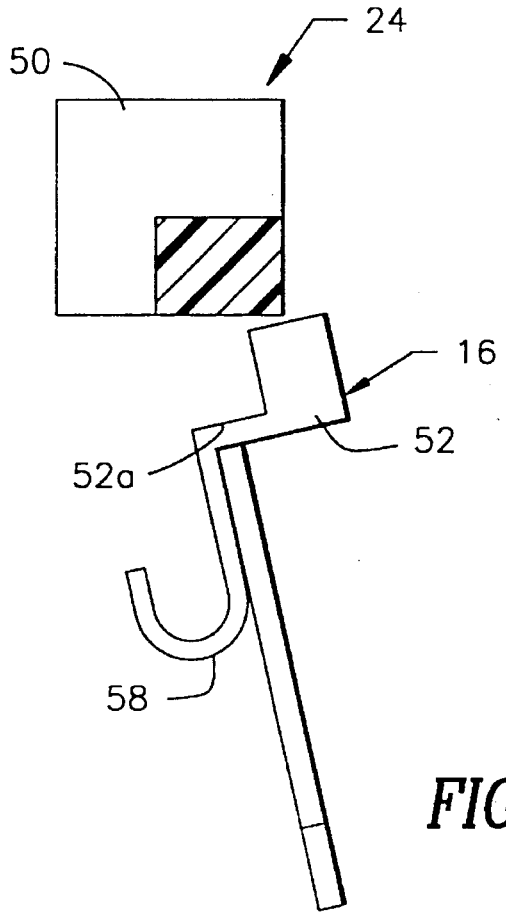
FIG. 23 depicts a situation in which the CPA member is not seatable with respect to the latch member.

If the assembly of header and socket is not proper, e.g., if one or both of the header latching projections are not properly resident in the socket latch member recesses, the latch members will take a non-alignment with respect to the CPA members, as is depicted in FIG. 23, again based on the pivotal support of the latch members. As a result, the CPA members are not seatable fully in the socket, thus providing indication to the user that there is a failure of connection position assurance.

By way of summary and in introduction of the ensuing claims, the invention will be seen to provide, in one aspect, an electrical connector assembly wherein a CPA member has a first portion movable in a first housing passage and has a second portion and wherein first and second latch means respectively with the first and second housings are engageable in the course of mating thereof, and wherein the first latch means is disposed in a path of movement of the CPA member second portion.

The first housing and the first latch means define mutually engageable means for retaining the first latch means with the first housing. The mutually engageable means comprises first and second projections on the first housing restraining the first latch means from movement along the connection axis. The mutually engageable means further comprises nesting means on the first housing cooperative with the first and second projections for restraining the first latch means from movement transversely of the connection axis. The nesting means comprises first housing structure partially circumscribing the first latch means.

The first latch means includes a first end portion extending upwardly of an uppermost surface of the first housing adjacent the first housing passage. The CPA member engages the first latch means first end portion in the course of CPA member movement in the first housing passage. The first latch means further includes a second end portion having a detent in facing relation with the second housing, the second latch means extending from the second housing into the first latch means detent.

The first housing and the CPA member are mutually configured such that the CPA member may take plural different positions relative to the first housing. The CPA member includes a toothed leg residing in the first housing passage and the first housing includes at lest one tooth disposed in the first housing passage.

As noted, in a further aspect, the invention provides an electrical connector assembly wherein first and second latch means respectively with first and second housings and engageable for effecting a first measure of securement of first and second housings and wherein a CPA member movable in the first housing passage is engageable with the first latch means for effecting a second measure of securement of the first and second housings.

While the above summary addresses the assembly of first and second housings, the invention also will be seen to provide an individual connector having a housing, a plurality of electrical contacts supported in the housing along a connection axis, a CPA member supported by the housing, and a latch member having first and second opposed ends, the latch member being supported by the housing for pivotal movement at a location between the first and second opposed ends thereof.

Various changes to the particularly disclosed embodiment and practices may evidently be introduced without departing from the invention. Accordingly, it is to be appreciated that the particularly discussed and depicted preferred embodiment and practices of the invention are intended in an illustrative and not in a limiting sense. The true spirit and scope of the invention are set forth in the ensuing claims.

What is claimed is:

1. An electrical connector assembly, comprising:

(a) a first housing supporting an array of first contacts and defining a passage for receipt of a CPA component;

(b) a second housing matable with said first housing by movement along a connection access and having an array of second contacts for mating engagement with said array of first contacts;

(c) a CPA member having a first and second portion, said first portion being movable in said first housing passage; and (d) first and second latch means respectively with said first and second housings and engageable in the course of mating thereof, said first latch means being disposed in a path of movement of said CPA member second portion and wherein said first housing and said first latch means define mutually engageable means for retaining said first latch means with said first housing.

2. The connector assembly claimed in claim 1, wherein said mutually engageable means comprises first and second projections on said first housing restraining said first latch means from movement along said connection axis.

3. The connector assembly claimed in claim 2, wherein said mutually engageable means further comprises nesting means on said first housing cooperative with said first and second projections for restraining said first latch means from movement transversely of said connection axis.

4. The connector assembly claimed in claim 3, wherein said nesting means comprises first housing structure partially circumscribing said first latch means.

5. The connector assembly claimed in claim 1, wherein said first latch means includes a first end portion extending upwardly of an uppermost surface of said first housing adjacent said first housing passage.

6. The connector assembly claimed in claim 5, wherein said CPA member engages said first latch means first end portion in the course of CPA member movement in said first housing passage.

7. The connector assembly claimed in claim 6, wherein said first latch means further includes a second end portion having a detent in facing relation with said second housing, said second latch means extending from said second housing into said first latch means detent.

8. The connector assembly claimed in claim 1, wherein said first housing and said CPA member are mutually configured such that said CPA member may take plural different positions relative to said first housing.

9. The connector assembly claimed in claim 8, wherein said CPA member includes a toothed leg residing in said first housing passage and wherein said first housing includes at least one tooth disposed in said first housing passage.

10. An electrical assembly, comprising:

(a) a first housing supporting an array of first contacts and defining a passage for receipt of a CPA component;

(b) a second housing matable with said first housing by movement along a connection axis and having an array of second contacts for mating engagement with said array of first contacts;

(c) first and second latch means respectively with said first and second housing and engageable for effecting a first measure of securement of said first and second housing, and wherein said first housing and said first latch means define mutually engageable means for retaining said first latch means with said first housing; and (d) a CPA member movable in said first housing passage and engageable with said first latch means for effecting a second measure of securement of said first and second housing.

11. The connector assembly claimed in claim 10, wherein said mutually engageable means comprises first and second projections on said first housing restraining said first latch means from movement along said connection axis.

12. The connector assembly claimed in claim 11, wherein said mutually engageable means further comprises nesting means on said first housing cooperative with said first and second projections for restraining said first latch means from movement transversely of said connection axis.

13. The connector assembly claimed in claim 12, wherein said restraining means comprises first housing structure partially circumscribing said first latch means.

14. The connector assembly claimed in claim 10, wherein said first latch means includes a first end portion extending upwardly of an uppermost surface of said first housing adjacent said first housing passage.

15. The connector assembly claimed in claim 14, wherein said CPA member engages said first latch means end portion in the course of CPA member movement in said first housing passage for effecting said second measure of securement of said first and second housings.

16. The connector assembly claimed in claim 15, wherein said first latch means further includes a second end portion having a detent in facing relation with said second housing, said second latch means extending from said second housing into said first latch means detent.

17. An electrical connector comprising:

(a) a housing defining a passage for receipt of a CPA component;

(b) a plurality of electrical contacts supported in said housing along a connection axis;

(c) a CPA member supported by said housing; and (d) a latch member having first and second opposed ends, said latch member being supported by said housing for pivotal movement at a location between said first and second opposed ends, and wherein said housing and said latch member define mutually engageable means for retaining said latch member with said housing and for effecting the pivotal movement support for said latch member.

18. The connector claimed in claim 17, wherein said mutually engageable means comprises first and second projections on said housing restraining said latch member from movement along said connection axis.

19. The connector claimed in claim 18, wherein said mutually engageable means further comprises nesting means on said housing cooperative with said first and second projections for restraining said latch member from movement transversely of said connection axis.

20. The connector claimed in claim 19, wherein said nesting means comprises housing structure partially circumscribing said latch member.

21. The connector claimed in claim 17, wherein said latch member includes a first end portion extending upwardly of an uppermost surface of said housing adjacent said housing passage.

22. The connector claimed in claim 21, wherein housing defines a passage for movement of said CPA member and wherein said CPA member engages said latch member first end portion in the course of CPA member movement in said housing passage.

23. The connector claimed in claim 22, wherein said latch member further includes a second end portion having a detent for receipt of a latching projection of another connector.

24. The connector claimed in claim 17, wherein said housing and said CPA member are mutually configured such that said CPA member may take plural different positions relative to said housing.

25. The connector claimed in claim 24, wherein said CPA member includes a toothed leg residing in said housing passage and wherein said housing includes at least one tooth disposed in said first housing passage.

* * * * *